US005445098A

United States Patent [19]

Marechal

[11] Patent Number: 5,445,098

[45] Date of Patent: Aug. 29, 1995

[54] LUFF GUIDING DEVICE AND IN PARTICULAR FOR A SAIL TO BE WOUND ON THE BOOM

[75] Inventor: Jean-Pierre Marechal, Saint Jean de Liversay, France

[73] Assignee: JP Marechal SA, Marans, France

[21] Appl. No.: 206,624

[22] Filed: Mar. 7, 1994

[30] Foreign Application Priority Data

Mar. 10, 1993 [FR] France ..... 93 03040

[51] Int. Cl.[6] ..... B63H 9/04

[52] U.S. Cl. ..... 114/102; 114/107

[58] Field of Search ..... 114/102, 106, 107

[56] References Cited

U.S. PATENT DOCUMENTS 4,930,434 6/1990 Clausin ..... 114/106

FOREIGN PATENT DOCUMENTS 0229675 7/1987 European Pat. Off. ..... 114/106

*Primary Examiner*—Jesus D. Sotelo

*Attorney, Agent, or Firm*—Sandler, Greenblum & Bernstein

[57] ABSTRACT

Luff guiding device for a sail, the sail being able to be wound on a boom of a sail boat, comprising a first element including a continuous groove in which a luff of a sail is engaged to freely circulate, the sail being able to be wound on a boom of a sail boat. The first element is positioned at a rear of a mast, and is pivotally mounted around a longitudinal axis extending through the element on both sides of a plane of symmetry of the sailboat.

21 Claims, 5 Drawing Sheets

LUFF GUIDING DEVICE AND IN PARTICULAR FOR A SAIL TO BE WOUND ON THE BOOM

FIELD OF THE INVENTION

The present invention concerns a sail reduction device, and more particularly the mainsail of a sailboat, by winding the latter on the boom and more particularly a winder boom.

BACKGROUND OF THE INVENTION

This type of boom is well known and makes it possible to reduce the mainsail vertically by winding it around a sheath mounted pivoting inside the boom, the driving in rotation of the sheath being effected by either an internal drum or by an electric or hydraulic motor.

However, this system gives mediocre results as it is used with a device for guiding the luff constituted by a vertical groove fixed to the rear of the mast.

This type of device has a number of drawbacks, including:

- the axis of this groove is offset with respect to the end of the winding shaft disposed inside the boom, which may result in an incorrect winding of the sail on the shaft and may form folds;
- owing to the fixity of the groove, the thrust of the battens on the luff makes it difficult to send, haul down or reduce the sail owing to friction, which requires that the sail is placed in the wind's eye;
- these problems concerning friction and parasitic torques make the system unusable in practice for sailboats larger than 12 meters.

SUMMARY OF THE INVENTION

The object of the invention is to overcome these drawbacks by providing a device suitable in particular for winding inside the boom of a batten mainsail by substantially reducing friction and forces generated at the linkage point between the mast and the sail and allowing for mainsail reduction within an angle range able to reach 45 degrees starboard side or port side with respect to the wind's eye in fully acceptable mechanical conditions.

To this effect, the invention concerns a luff guiding device and in particular, a sail able to be wound on the boom of a sailboat, wherein it is constituted by a continuous groove in which the luff is engaged and freely circulates, the groove being disposed at the rear of the mast and mounted pivoting freely around its axis with a specific amplitude on both sides of the plane of symmetry of the sailboat.

Preferably, the head plate and the possible battens of the sail are connected to said luff by means of T-shaped slides, the horizontal bar of the T being hollow and surrounding the luff at a distance whilst the vertical bar of the T is firstly connected to the head plate and battens by means of an articulated joint, and secondly extends inside a notch fitted in the sail around the slide.

The vertical bar of the T of the slides preferably has opposite the entrance flanks of the guiding groove of the luff a surface made of a material having a low coefficient of friction.

In the case of a sail able to be wound on the boom, the groove is preferably disposed straight above the end of the winding device of the boom and is extended at its lower end by a slit conical guide facilitating the transition of the luff and its slides from the groove to the device for winding the sail and mainly from the latter towards the groove for more particularly a full engaging of the slides.

With this type of device, the pivoting-mounting of the guiding groove enables the latter to follow the pivoting of the sail/battens/slides unit around the axis of the luff so that inside the entire angular clearance range of this unit, the possible reduction of the sail shall be effected correctly with a minimum of friction occuring between firstly the luff and the slides and secondly the guiding groove.

BRIEF DESCRIPTION OF THE DRAWINGS

Other characteristics and advantages of the invention shall appear more readily from a reading of the following description given by way of example of one embodiment of the device of the invention with reference to the accompanying drawings on which.

DETAILED DESCRIPTION OF THE DRAWINGS

Figure 1:
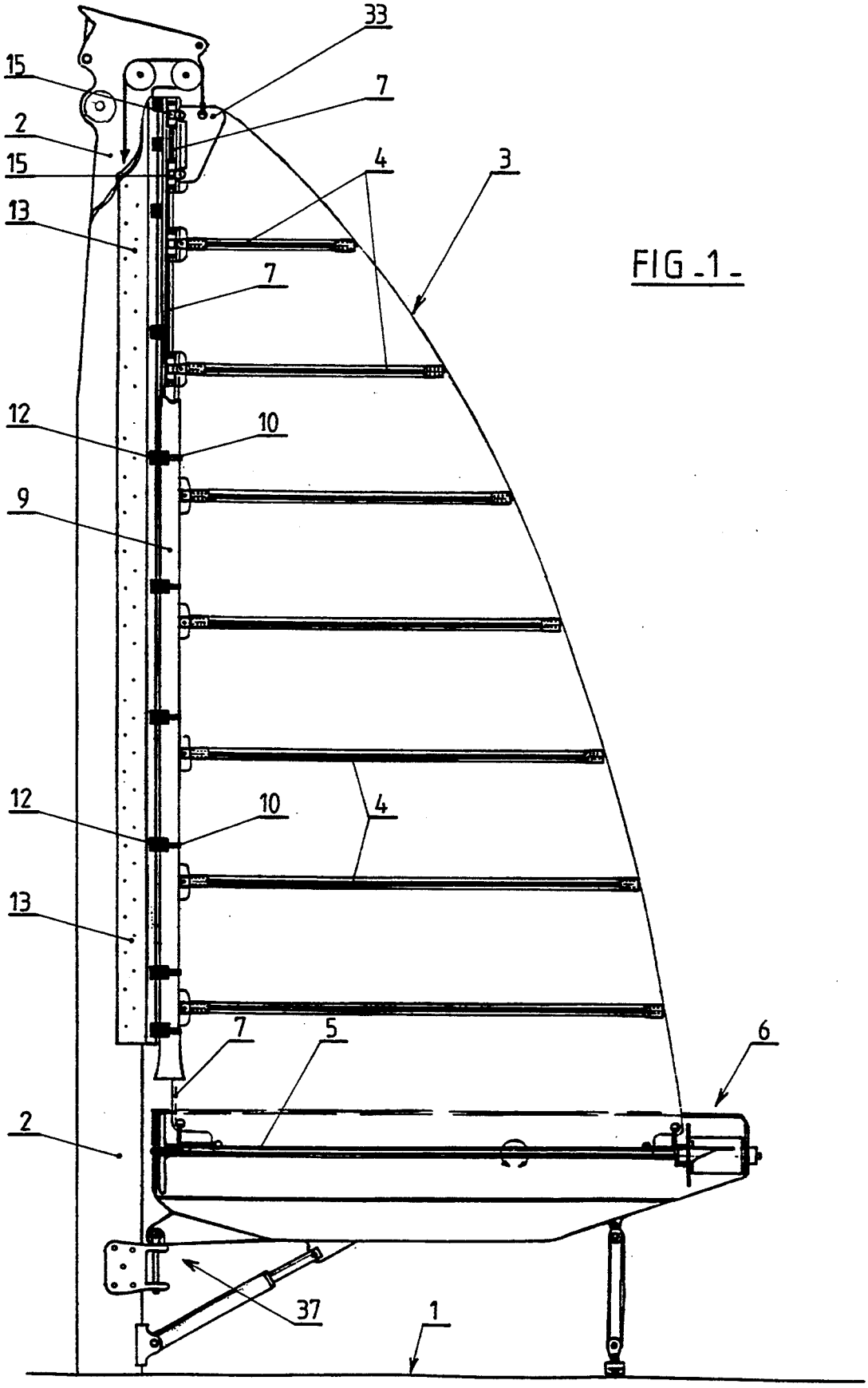
FIG. 1 is a lateral front view of a mainsail with battens to be wound on the boom with the aid of a device conforming to the invention.
Figure 2:
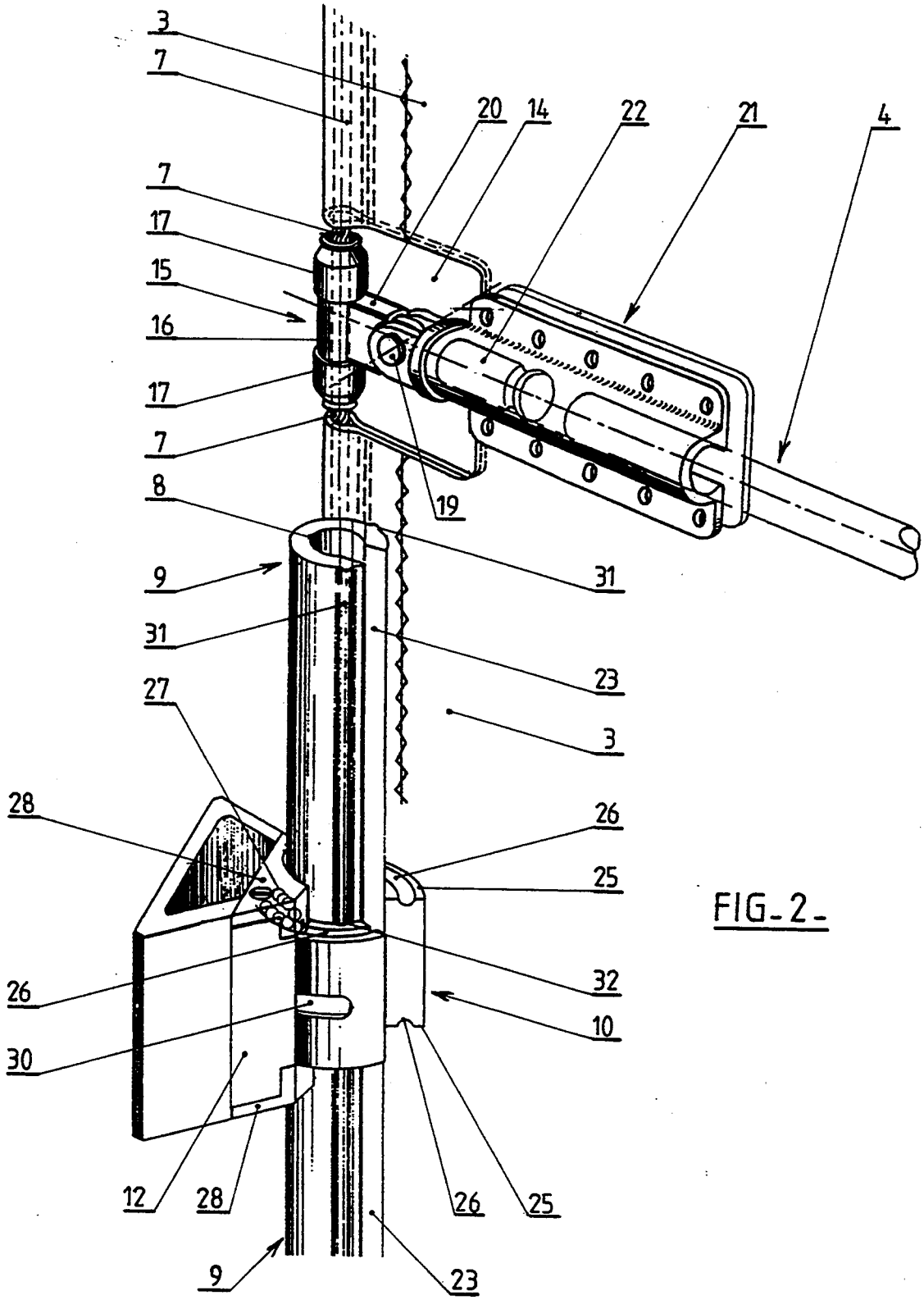
FIG. 2 is a partial perspective view of the device for guiding the luff of the mainsail.

FIG. 1 diagrammatically shows at 1 the deck of a sailboat, and at 2 the mast supporting a mainsail 3 with battens 4 and able to be wound onto a winding shaft 5 disposed inside the boom 6.

In accordance with the invention, the luff 7 of the mainsail 3 is mounted sliding in a groove 8 defined by a C-shaped profile 9 whose upper portion in FIG. 1 is pulled away so as to show the luff 7.

Figure 4:
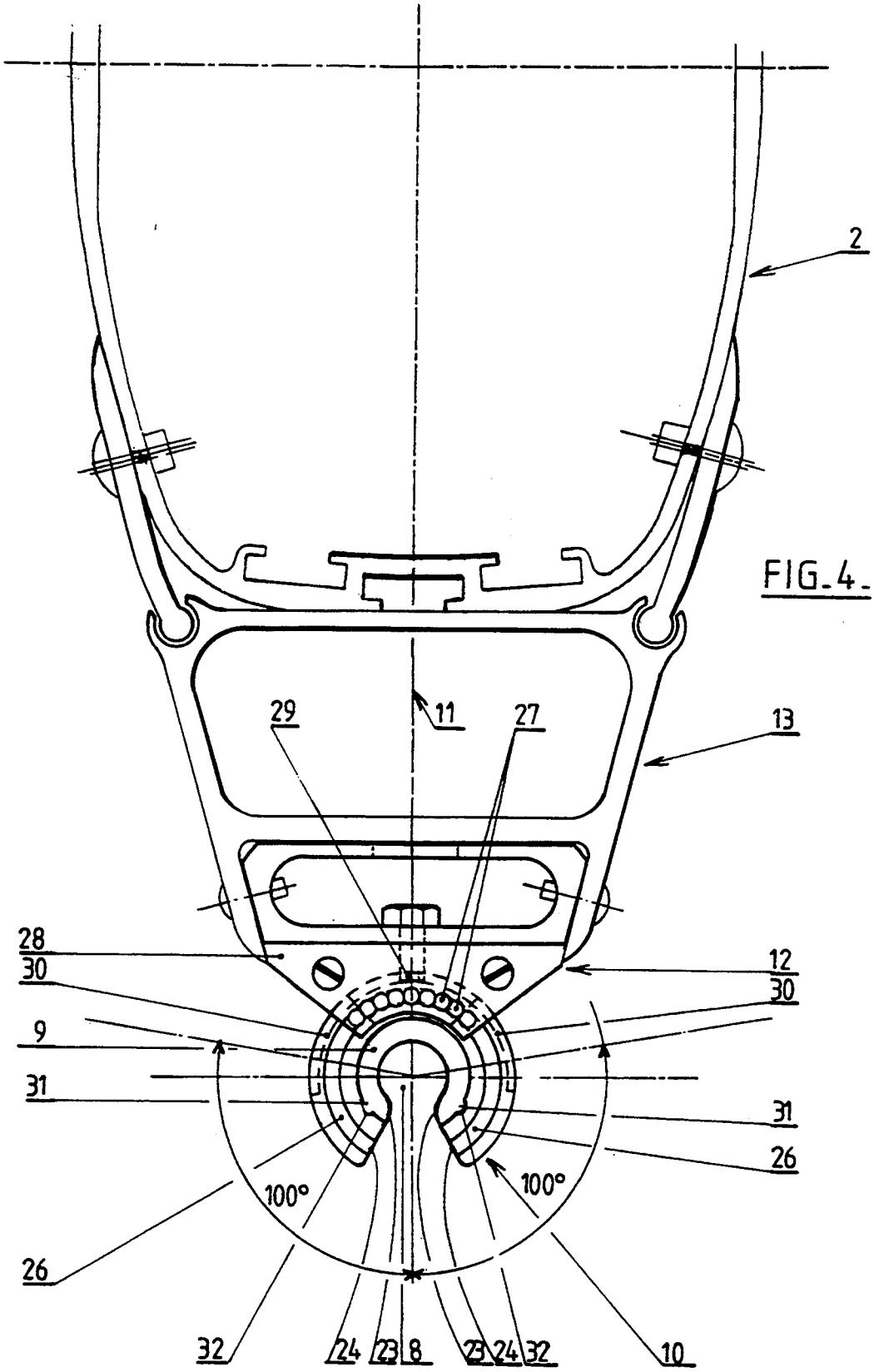
FIG. 4 is a partial cutaway view along the line IV—IV of the mast and the guiding device of FIG. 1.

The profile 9 is fixed vertically straight above the end of the winding shaft 5 and at the rear of the mast 2 by means of bearing rings 10 of ball bearings disposed distanced from one another along the profile 9 and enabling the latter to freely pivot around its axis by an angle, for example, of about one hundred degrees, as shown in FIG. 4, on both sides of the plane of symmetry of the mainsail symbolized at 11 on the FIG. 4. The bearing rings 10 are provided in sufficient numbers so as to ensure a suitable distribution of the loads applied by the sail 3 on the luff 7.

In the embodiment shown, the bearing rings 10 generally possess the shape of a C (FIG. 4) so as to correspond with the section of the profile 9 and are borne by bearing bodies mounted on a linking element 13, itself also mounted on the rear face of the mast 2, the unit providing the groove 8 with the position straight above the end, mast side, of the winding shaft 5, as indicated earlier.

The luff 7 is a rope bundled into a double fold of the canvas of the sail 3, notches 14 being fitted in the sail opposite the junction points between the battens 4 and the luff 7.

Figure 3:
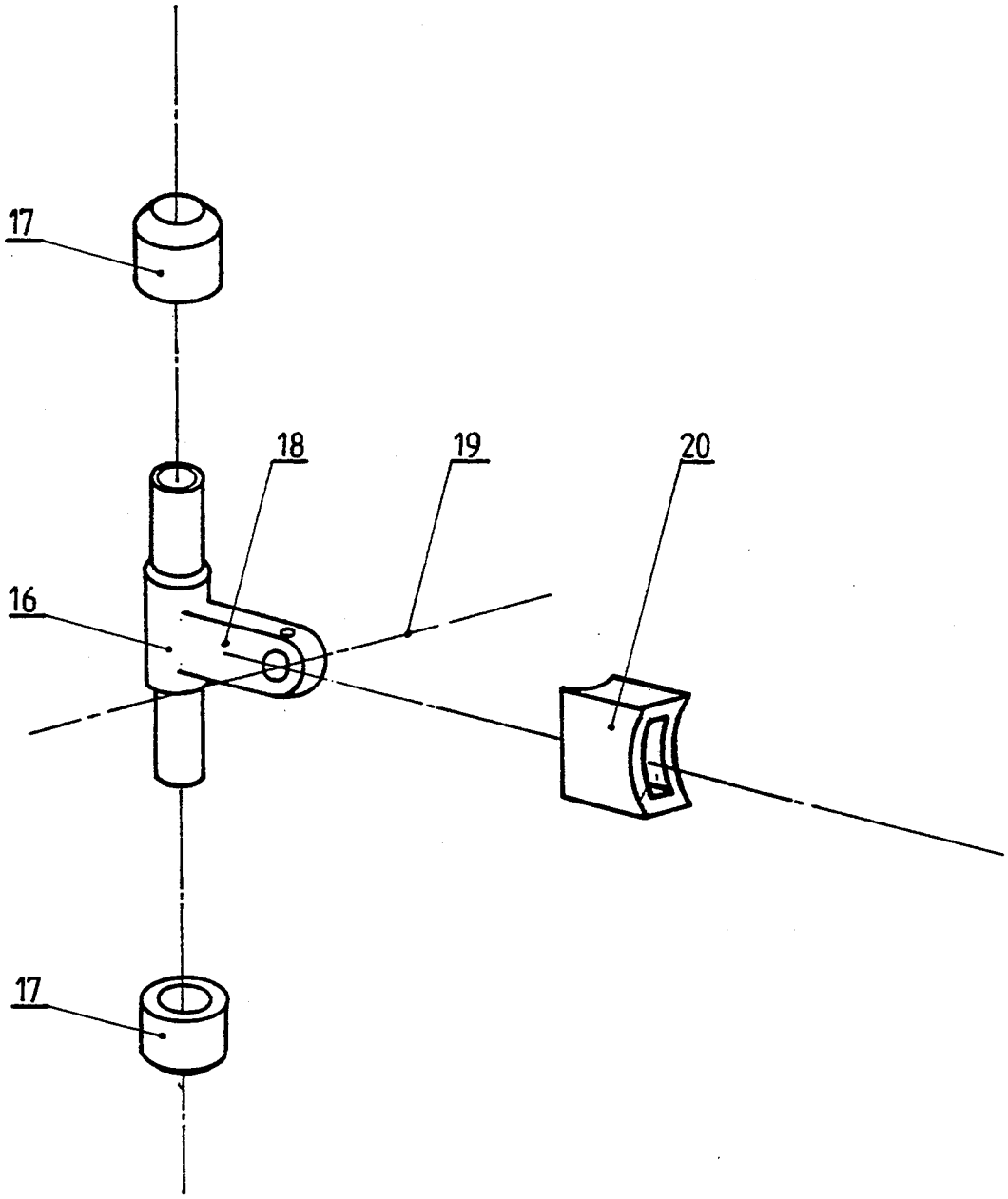
FIG. 3 is an exploded view of a luff slide.

Slides 15 with the overall shape of a T are disposed in these notches 14 and are shown exploded in FIG. 3.

The horizontal bar of the T is a tubular element 16 inside which the luff 7 is wound without there being any linkage between the latter and the element 16.

The two ends of the element 16 are sleeve-coupled with the aid of an element 17 made of a material with a low coefficient of friction, such as a plastic material.

The vertical bar of the T comprises a rod 18 with a rectangular section at the end of which is a batten 4 joined around a horizontal axis 19, the rod 18 being surrounded by a sliding sleeve 20 made of a material with a low coefficient of friction of the same type as the elements 17.

The batten 4 is connected to the rod 12 via a conventional batten box 21 and its cylindrical linking end piece 22.

The entire luff 7 and its canvas casing and slides 15 arranged in series along the luff are able to slide freely inside the profile 9. The outer diameter of the element 17 is slightly larger than that of the luff 7 (with its canvas) and slightly smaller than the internal diameter of the profile 9, that is of the guiding groove 8.

Friction thus mainly occurs at the level of the elements 17.

The rod 18/sleeve 20 assembly is dimensioned so as to slide freely in the longitudinal slit of the profile 9 defining the entrance of the groove 8. To this effect, the flanks 23 opposite the entrance of the groove 8 are approximately parallel and receive the forces recovered by the elements 20 of the slides 15 emanating from the battens 4.

It is to be noted that the faces 24 opposite (FIG. 4) the opening provided in the rotary rings 10 in the extension of the entrance of the groove 8 stand back from the flanks 23 and are thus not subjected to rubbing of the slides 15.

The rings 10 and the bearing bodies 12 have a particular structure.

Briefly, each ring 10 has an open ring shape having two flat parallel end faces 25 with the shape of a C on which are fitted two arc of a circle raceways 26 centered on the axis of the ring 10.

Balls 27 can circulate in these raceways 26 and can also circulate in a housing provided in an element 28 integral with the bearing body 12 and mounted opposite the faces 25.

The shape of the housing of the elements 28 is such that two closed loop raceways 27 can be fitted between the elements 28 and the ring 10. These balls 27 are arranged in series along the loop which extends inside a cylindrical plane coaxial to the ring 10 and which is formed of two parallel arcs of a circle disposed above each other and connected at their corresponding ends by arcs of a circle.

Thus, when the ring 10 rotates with respect to the bearing body 12, the balls 27 circulate along the fixed closed loop, partly delimited in the piece 28 and partly by a fraction of the raceway 26, and the forces transmitted to the rings 10 by the profile 9 and emanating from the sail 3 are transmitted to the mast 2 in suitable conditions, that is within the axis of the luff 7 and fully converging with the pivoting center of the latter, irrespective of the angular position of the ring 10 with respect to the bearing body 12 within angular clearance limits which of course are determined and fixed by a fixed projection 29 (FIG. 4) mobile in an arc of a circle groove 30 fitted on the cylindrical outer face of the ring 10.

The maximum angular clearance angle of 200 degrees of the ring 10 shown on FIG. 4 is thus delimited by the maximum travel of the projection 29 in the groove 30.

The rendering integral in rotation of the profile 9 and the rings 10 is ensured by protrusions 31 fitted on the external flanks of the profile 9 and engaged in grooves 32 with a complementary shape provided in the internal cylindrical wall on the rings 10.

The head plate is connected to slides 15 integral with the luff 7.

Figure 5:
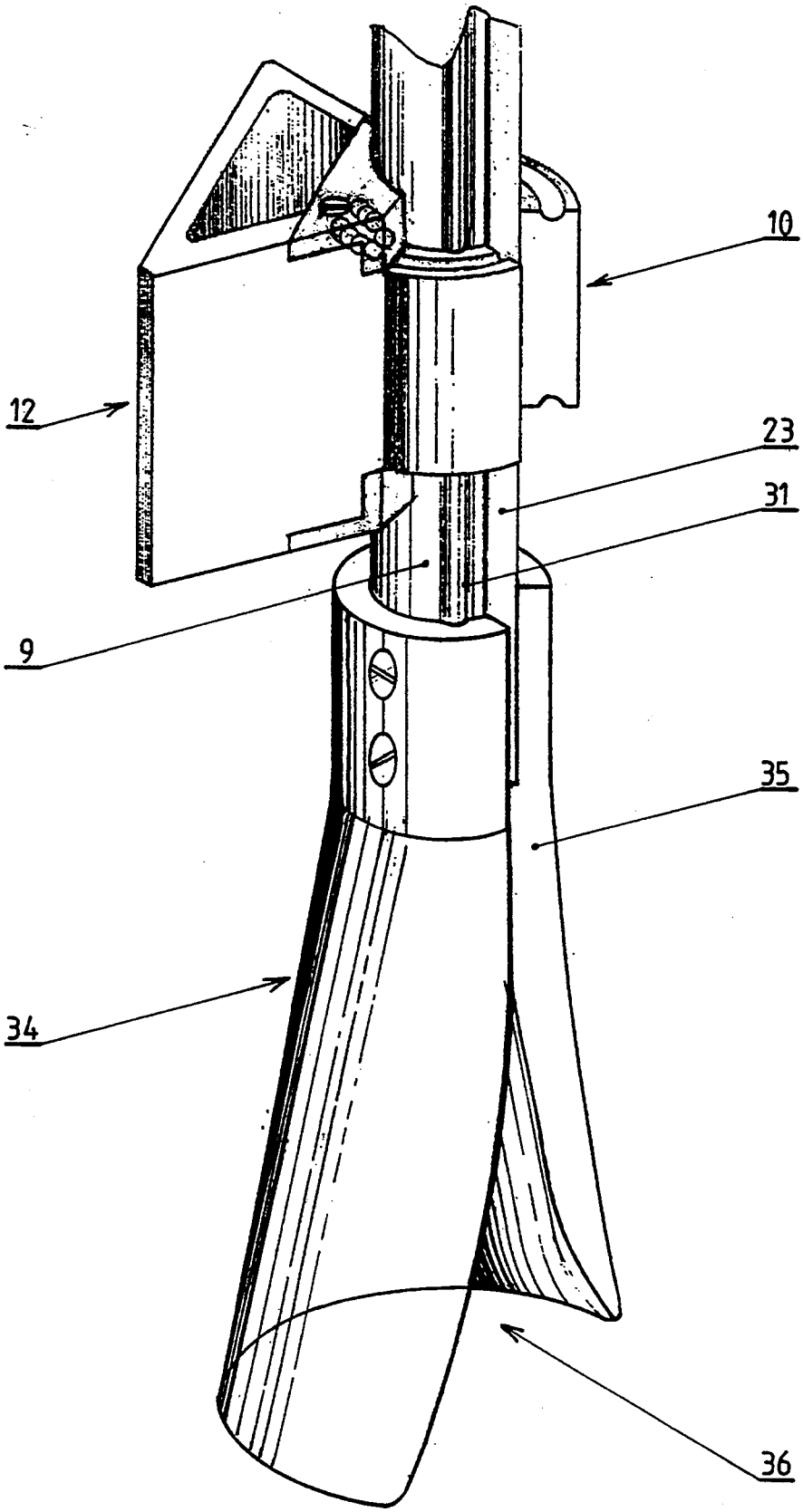
FIG. 5 is a perspective view of the lower end of the guiding device of the invention.

Advantageously disposed at the lower end of the profile 9 (FIG. 5) is a slit conical guide 34. The flanks 35 of the longitudinal slit of the guide 34 are located in the extension of the flanks 23 and deviate so as to define at the lower end of the guide 34 a wide opening 36 overhanging the end of the winding shaft 5 of the boom 6 and in particular facilitating the engaging of the slides 15 in the profile 9 when deploying the sail 3.

As indicated earlier, the device of the invention allows for the sending and hauling down of the sail 3 by fully extending the guiding groove 8, that is without any parasitic folds forming when rolling the sail on the shaft 5 at any speed and without the boat necessarily being in the direction of the wind owing to the free angular clearance of the profile 9 under the pressure of the battens 4 and without adversely affecting the free sliding of the luff 7 inside the profile 9.

The slides 15/battens 4 unit has a reduced spatial requirement, thus avoiding the creation of an excessive volume when winding the sail 3.

The luff with its slides 15 form a continuous unit from the head plate 33 to the low rigging point with a reduced spatial requirement easily sliding into the profile 9 and easily winding onto the shaft 5 and under an acceptable spatial requirement volume.

The fact of providing the profile 9 standing back with respect to the mast 2 permits a minimum space for the connecting system 37 of the boom 6 to the mast 2.

The luff 7 and its slides 15 move inside the profile 9 along an axis which coincides with the rotation axis of the profile 9 so that the traction and compression forces of the battens 4 for transmitting to the mast 2 the propulsion forces of the sail 3 are recovered as much as possible on the mast 2 without any parasitic torque able to alter the rising and falling movements of the luff 7 inside the profile 9.

The slides 15 allow a vertical rotation of the battens 4 around the spindle 19 and do not comprise any lateral joint as on sails with conventional battens. This enables the battens to drive in rotation the slides 15 around the axis of the luff and consequently the rotating profile 9. The rotation amplitude of the profile 9 is about 100 degrees on each side but may of course be adapted via a simple adjustment of the length of the groove 30 in which the stop 29 circulates.

Owing to the facility and safety of the manoeuvre for rising and lowering the luff 7, the device of the invention can be fully automated.

The invention is applicable to sails with battens, but may also be used for sails without battens.

Although the invention more particulary concerns sailboats equipped with a winder boom, it is nevertheless possible to have the luff guiding device with a pivoting guide (profile 9) so as to reduce the surface of a mainsail by reefing, the mainsail being merely hauled down vertically by reducing its height on the mast, without winding on the boom.

In addition, the device of the invention can be used sailboats of any size.

Finally, the invention is not merely limited to the embodiment shown and described above, but on the contrary covers all possible variants, especially as regards the shapes and dimensions of the slides 15, the rotating profile 9 and its slide groove 8. Similarly, the rotating ring 10 and bearing body 12 may be replaced by any other device able to support the profile 9 and allow for its angular pivoting according to a certain angle, possibly able to be adjusted, and whilst leaving fully free access inside the profile 9 over its entire height.

What is claimed is:

1. Luff guiding device for a sail, the sail being able to be wound on a boom of a sail boat, comprising:

a first element including a continuous groove in which a luff of a sail is adapted to be engaged to freely rotate, said first element comprising said continuous groove adapted to be positioned at a rear of a mast, and is pivotally mounted around a longitudinal axis extending through said element to both sides of a plane of symmetry of a sailboat.

2. The device according to claim 1, including T-shaped slides slidably positioned in said continuous groove, said T-shaped slides comprising a hollow bar surrounding the luff in a spaced manner, a substantially perpendicular bar connected by an articulated joint to battens, and a head plate, and adapted to extend inside a notch fitted in the sail around each T-shaped slide.

3. The device according to claim 2, wherein said hollow bar has ends, and said ends of said hollow bar are composed of a material with a low coefficient of friction ensuring contact between the luff and said continuous groove.

4. The device according to claim 3, wherein said continuous groove comprises entrance flanks, and said substantially perpendicular bar at a position opposite said entrance flanks is composed of a material having a low coefficient of friction.

5. The device according to claim 2, wherein said continuous groove comprises entrance flanks, and said substantially perpendicular bar at a position opposite said entrance flanks is composed of a material having a low coefficient of friction.

6. The device according to claim 1, wherein said first element comprises a tubular profile having a height, and is longitudinally slit along said height forming said continuous groove, and comprises a C-shaped cross-section.

7. The device according to claim 6, comprising bearing bodies adapted to be mounted on the rear of the mast, rings fixedly spaced along said tubular profile, said rings partially surrounding said tubular profile so that said continuous groove includes a free entrance, and said rings are rotatably mounted on said bearing bodies.

8. The device according to claim 7, comprising a stop system to determine an amplitude of rotation of said rings on both sides of the plane of symmetry of the sailboat.

9. The device according to claim 8, wherein said amplitude of rotation is about 100 degrees on port and starboard sides.

10. The device according to claim 8, wherein said stop system comprises a groove on an outer face of said rings, and a fixed stop projection movable in said groove.

11. The device according to claim 7, wherein said rings comprise elements having a cylindrical shape with two parallel end faces, a raceway positioned in each of said two end faces cooperating with additional raceways in said bearing bodies, and balls positioned in said raceways.

12. The device according to claim 11, wherein said raceway in each of said two end faces comprises an arc of a circle, said additional raceways comprise an uneven bent shape, to thereby form an uneven closed loop.

13. The device according to claim 1, wherein said first element comprises a lower end, and a slit conical guide is positioned at said lower end for facilitating transition of the luff between said continuous groove and a device for winding the sail on a boom.

14. Luff guiding device, comprising:

a first element including a continuous groove in which a luff of a sail is engaged to freely rotate, the sail being able to be wound on a boom of a sail boat, said first element comprising said continuous groove positioned at a rear of a mast, and pivotally mounted around a longitudinal axis extending through said element to both sides of a plane of symmetry of a sailboat.

15. The device according to claim 14, including T-shaped slides slidably positioned in said continuous groove, said T-shaped slides comprising a hollow bar surrounding the luff in a spaced manner, a substantially perpendicular bar connected by an articulated joint to battens, and a head plate, and adapted to extend inside a notch fitted in said sail around each T-shaped slide.

16. The device according to claim 14, wherein said hollow bar has ends, and said ends of said hollow bar are composed of a material with a low coefficient of friction ensuring contact between the luff and said continuous groove.

17. The device according to claim 16, wherein said continuous groove comprises entrance flanks, and said substantially perpendicular bar at a position opposite said entrance flanks is composed of a material having a low coefficient of friction.

18. The device according to claim 14, wherein said first element comprises a tubular profile having a height, and is longitudinally slit along said height forming said continuous groove, and comprises a C-shaped cross-section.

19. The device according to claim 18 comprising bearing bodies adapted to be mounted on the rear of the mast, rings fixedly spaced along said tubular profile, said rings partially surrounding said tubular profile so that said continuous groove includes a free entrance, and said rings are rotatably mounted on said bearing bodies.

20. The device according to claim 19, comprising a stop system to determine an amplitude of rotation of said rings on both sides of the plane of symmetry of the sailboat.

21. The device according to claim 14, wherein said first element comprises a lower end, and a slit conical guide is positioned at said lower end for facilitating transition of the luff between said continuous groove and a device for winding the sail on a boom.

* * * * *